US005135345A

United States Patent [19]

Kazanjian

[11] Patent Number: 5,135,345

[45] Date of Patent: Aug. 4, 1992

[54] GOLF BALL RETRIEVING APPARATUS

[76] Inventor: Casey Kazanjian, 3301 Llewellyn Rd., Olney, Md. 20832

[21] Appl. No.: 640,871

[22] Filed: Jan. 14, 1991

[51] Int. Cl.[5] ..... B60P 3/00

[52] U.S. Cl. ..... 414/442; 56/328.1; 414/439; 171/43; 171/45; 171/101

[58] Field of Search ..... 414/434, 435, 436, 437, 414/438, 439, 440, 441, 442, 443, 501, 537; 56/328.1; 171/141, 104, 105, 43, 85, 86, 101

[56] References Cited

U.S. PATENT DOCUMENTS

| | | | |
|---|---|---|---|
| 2,484,437 | 10/1949 | Wells | 414/440 |
| 2,514,699 | 7/1950 | Hiatt | 56/328.1 X |
| 2,735,562 | 2/1956 | Kazanjian | 414/434 |
| 2,940,242 | 6/1960 | Patterson | 56/328.1 |
| 3,362,551 | 1/1968 | Shoemaker | 56/328.1 X |
| 3,593,868 | 7/1971 | Folz | 56/328.1 X |
| 3,630,401 | 12/1971 | Gustafson et al. | 56/328.1 X |
| 3,777,462 | 12/1973 | Sharp et al. | 56/328.1 |

FOREIGN PATENT DOCUMENTS

| | | | |
|---|---|---|---|
| 2555455 | 5/1985 | France | 414/441 |

*Primary Examiner*—Frank E. Werner
*Attorney, Agent, or Firm*—Edmund M. Jaskiewicz

[57] ABSTRACT

An apparatus for retrieving golf balls comprises a structure which may be dragged behind or pushed by a tractor. The structure comprises a plurality of golf ball containers which are individually and flexibly connected to the dragging structure. Rearwardly converging guide means are also flexibly connected to the dragging structure for guiding golf balls into front openings in each of the ball containers. In front of each ball container opening is a lift gate comprising a plurality of fixed strands and a lowermost pivotable strand for dislodging partially buried golf balls. A paddle structure rotates in conjunction with the lift gate to assist golf balls upwardly into the container and the paddle structure is connected to ground engaging wheels which rotate as the apparatus is dragged in operation.

13 Claims, 5 Drawing Sheets

GOLF BALL RETRIEVING APPARATUS

The present invention relates to a golf ball retrieving apparatus, more particularly, to a vehicular structure which is adapted to be pushed or pulled over a field by a tractor or the like, such as the turf of a golf practice driving range, to collect the golf balls that have been scattered thereover.

Patrons of such driving ranges are each provided with a plurality of golf balls at a teeing point and they drive the balls successively out over the range. Periodically it is necessary to canvass the field for recovery of the balls and to bring them back to the teeing point for reuse. Initially, this operation was performed manually by attendants who traversed the field on foot, searched for the balls among the grass, picked up those balls which were visible to them, collect them in buckets or baskets and then walk back with such quantity as they are able to carry. This proved to be a tedious, laborious, time-consuming and hence expensive procedure. As a result, various forms of apparatus have been devised over the years in an attempt to provide a more effective and less expensive procedure for recovering the golf balls or other spherical objects. The usual apparatus is wheeled and is either driven or dragged over the field and the apparatus picks the golf balls from the ground and deposits the golf balls into a container. The apparatus is then driven or dragged back to the teeing point and the gathered balls are available for reuse.

Several prior art golf ball retrieving machines which utilized a rotating brush or paddle to pick up golf balls are disclosed in U.S. Pat. Nos. 3,362,515; 3,566,893 and 3,593,868. Other forms of golf ball retrieving devices employ a plurality of thin spaced discs to pick up the balls and such devices are disclosed in U.S. Pat. Nos. 3,995,759; 3,823,838 and 4,792,271. Additional prior art machines for retrieving golf balls are disclosed in U.S. Pat. Nos. 3,175,714; 3,664,532; 3,630,401; 3,888,370; 3,989,159; 4,157,141; 4,252,490 and 3,825,136.

While the prior art golf ball retrieving devices perform with various degrees of efficacy, they have the disadvantage that they do not provide for the simple and effective collecting of golf balls which are at ground level, in small depressions or partially buried in the ground, straining out grass and other foreign objects smaller than the diameter of a golf ball and then depositing the golf ball free of extraneous matter in a container while utilizing a structure which is sufficiently flexible to closely conform to the configuration of the terrain but which is simple and effective in operation but inexpensive to construct and maintain.

The present invention is an improvement in the golf ball retrieving apparatus disclosed in U.S. Pat. No. 2,735,562 issued on Feb. 21, 1956 to applicant.

It is therefore the principal object of the present invention to provide a novel and improved apparatus for retrieving golf balls and the like.

It is an additional object of the present invention to provide such an apparatus which will cover a wide band or zone of the field at each traverse and which will accurately and efficiently conform automatically to the contour of any irregular terrain over which it may be necessary to operate.

It is a further object of the present invention to provide such an apparatus which will unfailingly pick up all balls over which it may pass, which can be constructed of a minimum number of parts which for the most part are made of standard structural shapes so that the cost of manufacture is kept reasonably low and which will be durable and effective in use.

The objects of the present invention are achieved and the disadvantages of the prior art are overcome by the apparatus according to the present invention which essentially comprises a tractor type vehicle which can be pulled or pushed by a power driven tractor in a number of parallel traverses over the field somewhat in the manner of an agricultural harvesting machine. This vehicle will collect and assemble all the balls over which the machine passes without relying on occular detection by the operator or on any labor or other action by him except for driving the tractor vehicle.

An apparatus for retrieving golf balls according to the present invention may comprise a golf ball receiving container which is roller supported and which has a flat bottom and upstanding side walls and front and rear walls with there being an opening in the front wall. Means are provided for dragging the roller supported container along and in contact with the ground. Supported from the dragging means are guide means which rearwardly converge toward the opening in the front wall of the container for directing golf balls towards said opening. Forwardly of the opening there is an upwardly inclined lift gate to define a path for the balls into the opening of the container. At the forward portion of the lift gate there is a freely suspended means which has limited pivotal movement so as to remain in contact with the ground for dislodging golf balls partially buried in the ground.

Other objects and advantages of the present invention will be apparent upon reference to the accompanying drawings, which are exemplary, wherein.

Figure 1:
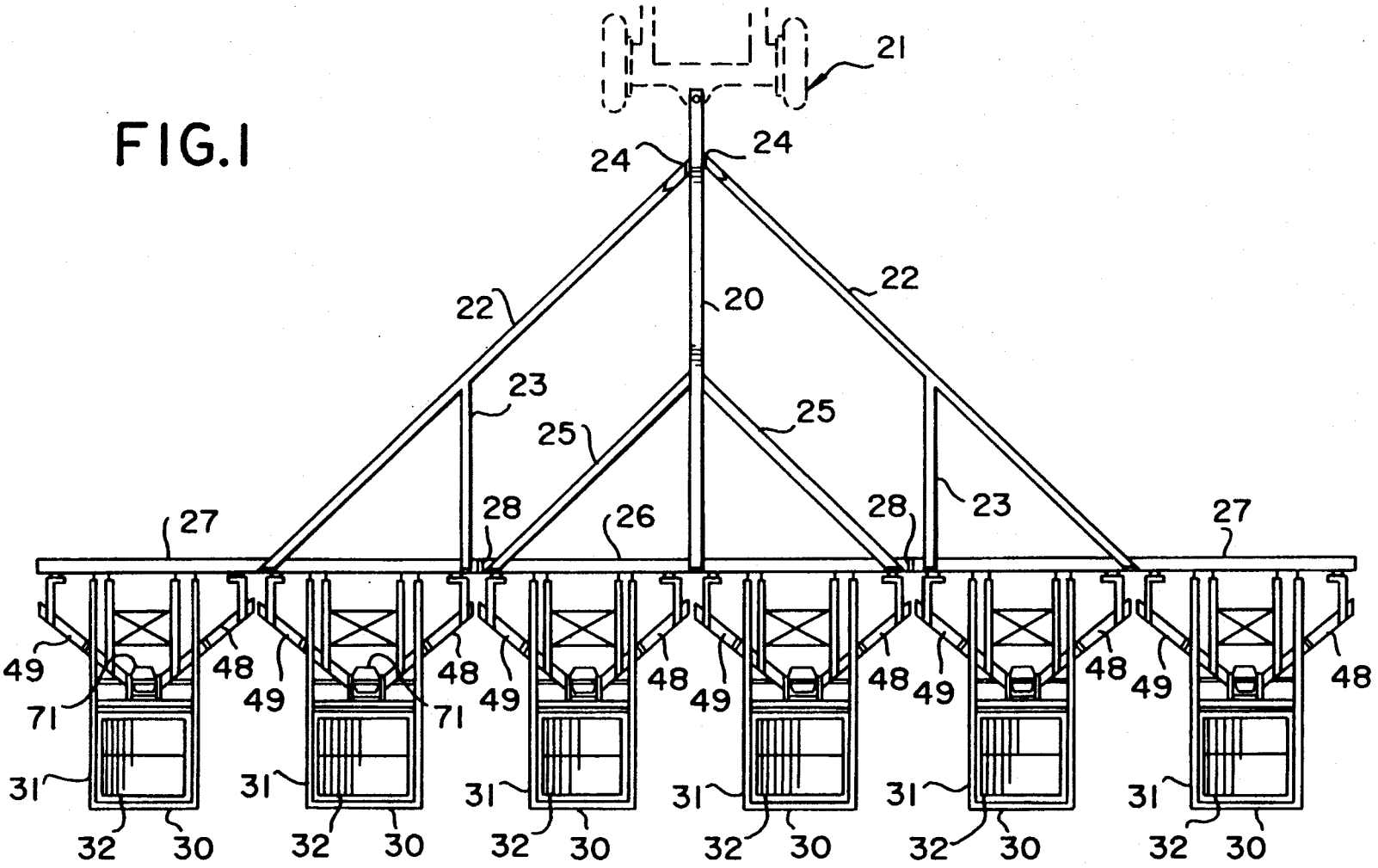
FIG. 1 is a top plan view of a complete embodiment of the present invention shown coupled to any conventional tractor vehicle.
Figure 2:
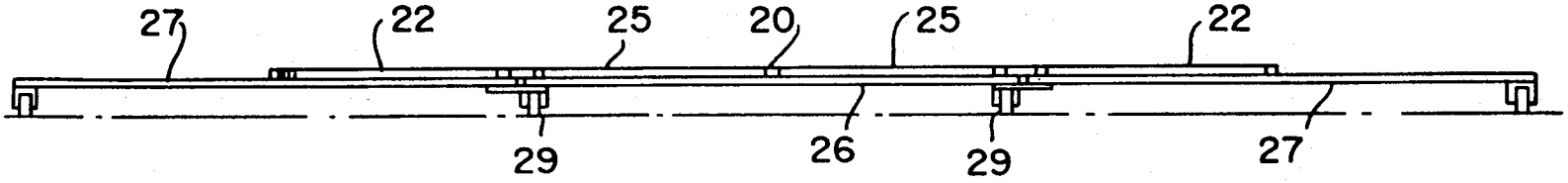
FIG. 2 is a rear elevational view of the apparatus shown in FIG. 1.
Figure 3:
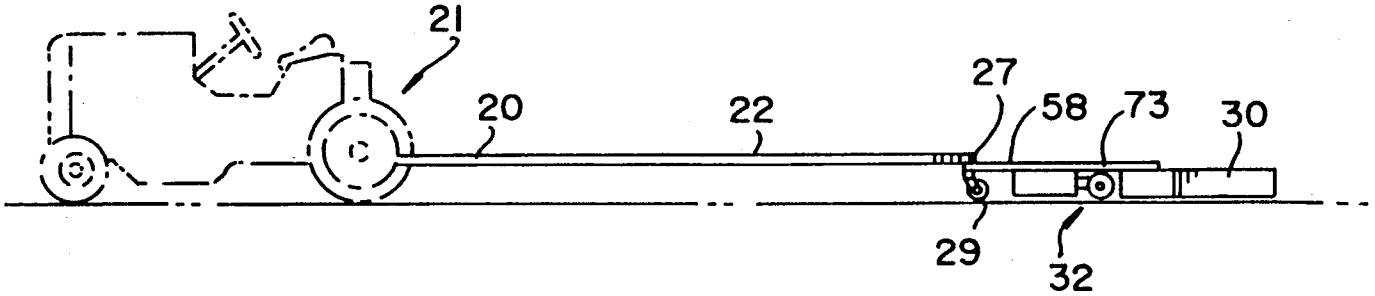
FIG. 3 is a side elevational view of the apparatus shown in FIG. 1.

Proceeding next to the drawings wherein like reference symbols indicate the same parts throughout the various views a specific embodiment and modifications of the present invention will be described in detail. With particular reference to FIG. 1, a draw bar 20 extends longitudinally rearwardly from a suitable pulling vehicle, such as a small tractor 21 to which the forward end of the draw bar may be coupled by any conventional hitch. A double framework consisting of two relatively long forward diagonal braces 22 and two relatively short longitudinal braces 23 are rigidly connected at the front ends to a median point on each of the diagonals 22. Forward ends of the diagonals 22 are hingedly connected at 24 to opposite sides of a forward point on the draw bar. A relatively short rear diagonal brace 25 is rigidly connected to each side of draw bar 20 at a point spaced behind hinges 24 so that each of the diagonals 25 parallels the adjacent diagonal 22 and terminates on a common transverse line established by the rear ends of the diagonals 22, longitudinal braces 23 and draw bar 20 at a point on a control cross bar member 26 spaced slightly inwardly from the end of the adjacent longitudinal 23. The draw bar, longitudinals and diagonals are preferably constructed of angle irons or other standard structural materials so that the framework comprising the draw bar 20 and the diagonals 25 is relatively rigid but capable of vertical swinging movement about the tractor hitch. Each framework made up of one of the diagonals 22 and the adjacent longitudinal 23 is also relatively rigid but is capable of limited up and down swinging movement about its hinge 24.

A cross bar assembly comprises the central cross bar member 26 and two lateral cross bar extensions 27 aligned axially and spanning the width of the apparatus as shown in FIG. 1. The central cross bar member 26 is rigidly connected at its mid point to the rear end of the draw bar 20 and is also rigidly connected near its ends to the rear ends of the two rear diagonals 25. The cross bar extensions 27 are each rigidly connected near their inner ends to the rear end of one of the longitudinals 23 and at about its mid point to the rear end of one of the diagonals 22 and with the inner ends of the extensions 27 connected by hinges 28 to the outer ends of the central cross bar member 26. The cross bar members may be made of the same materials as the draw bar, diagonals and longitudinals and each of the cross bar members is mounted on a pair or more of wheels, rollers or casters 29 which support the cross bar assembly for rolling over the ground.

Each of the cross bar members 26 and 27 may be made in lengths of from 10 to 14 feet. The pivoting action of the tractor hitch and of the hinges 24 between the diagonals 22 and draw bar 20 and the hinges 28 at the ends of the cross bar members will enable these members to follow quite faithfully the contours of any turf in any field capable of being used as a golf practice driving range.

To the outer ends of the cross bar extensions 27 there may be connected by hinges such as the hinges 28 additional extensions (not illustrated) to increase the width of the band or zone to be covered by each traverse up to about 36 feet.

Figure 4:
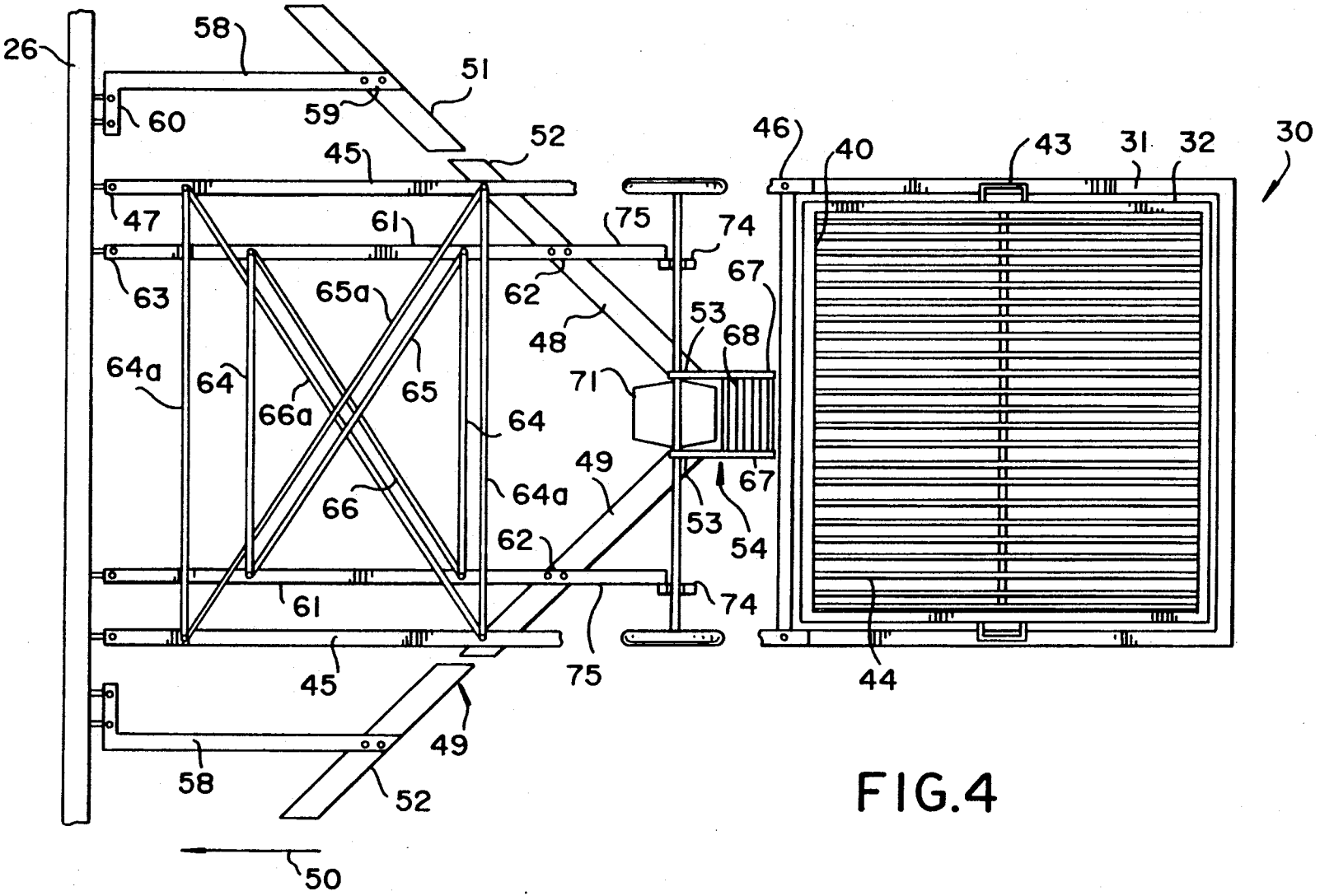
FIG. 4 is a top plan view in enlarged scale of one of the ball receiving containers connected to the cross bar.

As may be seen in FIG. 1, connected to each of the cross bar members 26 and 27 is a plurality of like golf ball receiving containers or trays 30 one of which is illustrated in enlarged scale and greater detail in FIG. 4. In one embodiment of the subject invention, the cross bar members 26 and 27 are made of a suitable length so that four trays can be connected to the center cross bar member 26 and three trays can be connected to each of the outer cross bar members 27. The resulting ten trays will cover a zone of at least 36 feet wide on each traverse.

Figure 5:
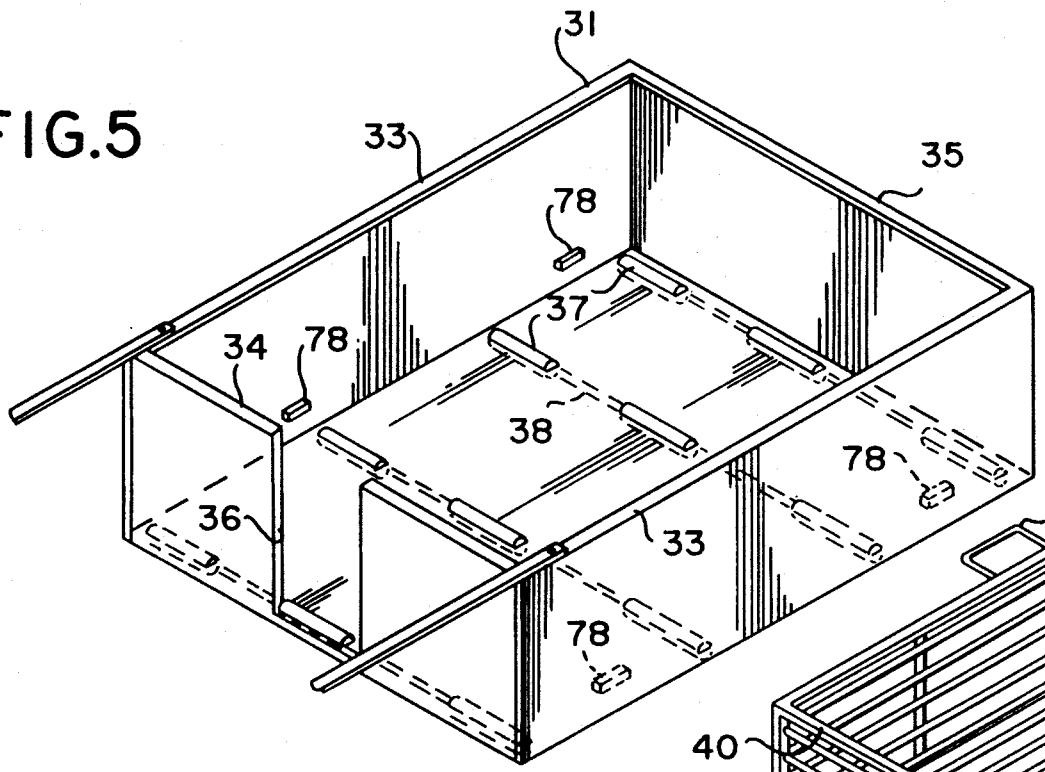
FIG. 5 is a top view in perspective of the outer tray of the ball receiving container.
Figure 6:
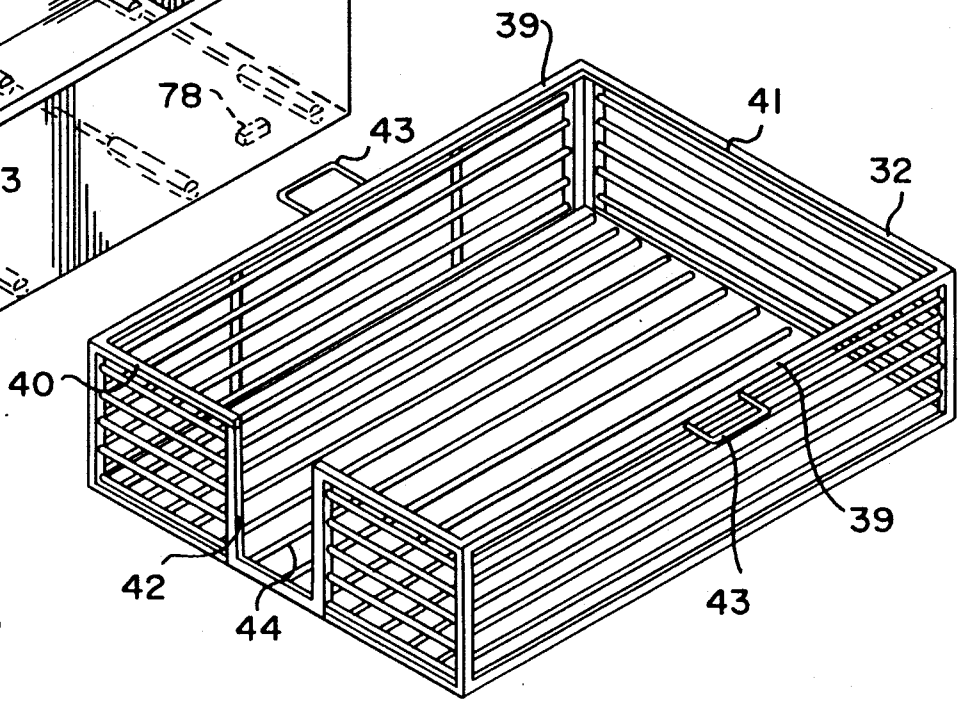
FIG 6 is a top perspective view of the inner tray which is assembled inside the outer tray of the ball receiving container.

Each golf ball receiving container 30 comprises an outer tray 31 shown in FIG. 5 and into which is seated an inner tray 32 shown in FIG. 6. The outer tray 31 comprises opposed vertical side walls 33 interconnected by a vertical or upstanding front wall 34 and an upstanding rear wall 35. The rear wall 35 may also be inclined at an angle of approximately 45 degrees to facilitate insertion and removal of the inner tray 32.

The front wall 34 is provided with an opening 36. The outer tray is supported on a plurality of rollers 37 journaled upon axles 38 extending between the bottom portions of the side walls 33. The side walls 33 and the front and rear walls 34 and 35 respectively may be made of a sheet material such as metal or plastic or of a mesh or screen constitution.

The inner tray 32 similarly comprises a pair of opposed vertical side walls 39 interconnected by a vertical front wall 40 and a vertical rear wall 41. The front wall has an opening 42 correspondingly positioned to register with the opening 36 in the front wall of the outer tray. The walls of the inner container 32 are interconnected by a bottom 44 so as to form a tray for collecting golf balls. The inner tray 32 has handles 43 on the upper edges of the side walls 39 and is preferably constructed in the form of a basket with a mesh or web structure formed of interconnected and intersecting rods which may be of metal or plastic material.

The inner tray 32 is dimensioned so as to fit comfortably within the outer tray 31 as shown in FIG. 4 such that the inner tray 32 may be easily removed from or inserted into the outer tray. Inner tray 32 rests upon stops 78 which are attached to the inner walls of outer tray 31 as shown so as to be positioned above rollers 37.

As may be seen in FIG. 4, each outer tray 31 is connected to a cross bar member such as 26 by a pair of tow bars 45 one end of which is pivotally attached to the upper forward portion of the outer tray at 46 and the inner end 47 is provided with a like swivel pin connection to the cross bar 26. These pivotal connections each may comprise an upstanding pin connected to the cross member 26 and the end of the pin is received within an opening in the end 47 of the tow bar 45.

Figure 9:
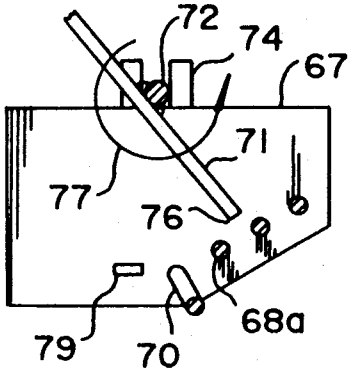
FIG. 9 is a sectional view taken along the line IX—IX of FIG. 8.
Figure 10:
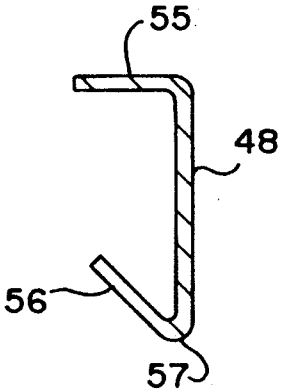
FIG. 10 is a transverse sectional view of a guide member.
Figure 7:
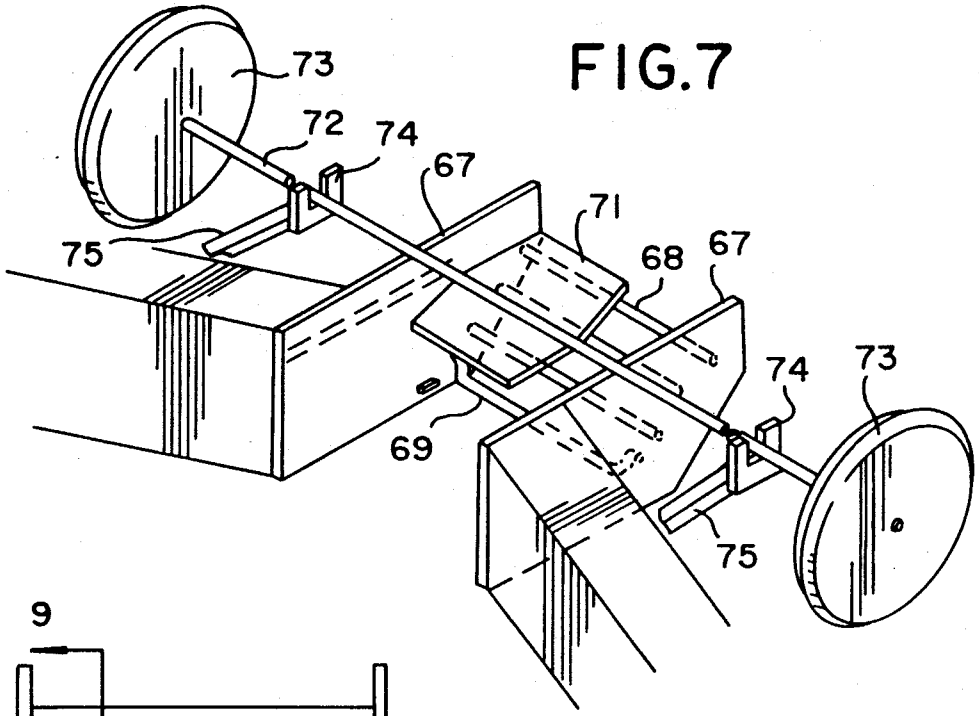
FIG. 7 is a front view in perspective showing the lift gate structure and the paddle associated with the lift gate structure and the axle and supporting wheels upon which the paddle is mounted.
Figure 8:
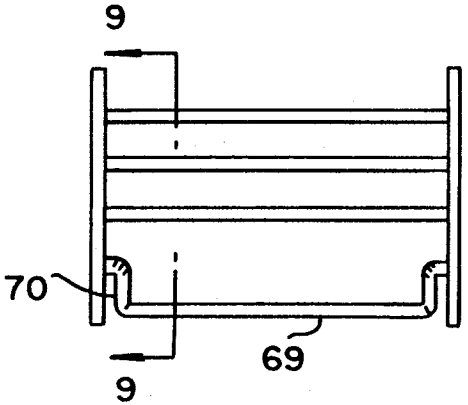
FIG. 8 is a front elevational view of the lift gate shown in FIG. 7.

In order to direct and guide golf balls on the ground toward the front wall opening 36 of the ball container 35 there is provided a pair of rearwardly converging guide assemblies each comprising inner guides 48 and 49. These guide members 48 and 49 converge rearwardly with respect to the direction of operating movement of the apparatus as indicated by the arrow 50. The guide assemblies further comprise outer guides 51 and 52. The outer guides 51 and 52 are preferably advanced about one inch or so forwardly of the respective rear guides 48 and 49 as shown in FIG. 4. The inner guides 48 and 49 each have inner ends 53 to which is attached a lift gate indicated generally at 54 and illustrated in greater detail in FIGS. 7–9 and to be subsequently described in greater detail. The guides 48, 49, 51 and 52 preferably have the configuration as shown in FIG. 10 so as to have an upper flange 55 substantially at right angles to the body of the guide and a lower or upturned lip 56 to provide a rounded surface 57 which rides upon the ground. The guide members 48, 49, 51 and 52 may be constructed of metal or of a plastic such as Teflon.

Each outer guide 51 and 52 is pivotally connected to the cross bar 26 by an L-shaped bar 58 having a rear end 59 which is rigidly connected to the top flange 55 of the respective outer guide 51 and 52 and whose inner end in the form of a bar 60 is connected at two places to the cross bar 26 by means of a pin and opening pivotal connection as previously described.

The inner guides 48 and 49 are pivotally connected to the cross bar 26 by a pair of tow bars 61 whose rear ends 62 are rigidly connected to the top flanges 55 of the inner guides 48 and 49 and whose inner ends 63 are pivotally connected to the cross bar 26 by a pin and eyelet pivotable connection as previously described. The pair of tow bars 61 are interconnected by a pair of spaced transverse flex braces 64 and a pair of diagonally positioned intersecting flexed braces 65 and 66. These flex braces 64–66 are fixedly connected to the tow bars 61 and are made of metal rods. Thus, the inner guides 48 and 49 which are fixedly connected to the lift gate 54 and are also fixedly connected to the ends of the tow bars 61, thus form a substantially rigid unit or assembly which is capable of pivotable movement with respect to the cross bar 26. In a similar manner, flex braces 64*a*, 65*a* and 66*a* interconnect tow bars 45 which drag the outer tray 31.

The lift gate 54 comprises a pair of side members 67 which are spaced apart a distance substantially equal to three golf balls. The side members 67 are of like shape such as illustrated in FIG. 9 and are interconnected by three rods or strands 68 positioned as shown in FIG. 9 so as to define an upward inclined ramp. Freely suspended between the side members 67 and forwardly and below leading strand 68 A is a substantially U-shaped catch-all bar 69 at the ends of which are legs 70 and the upper ends of the legs 70 are journaled in the side member 67. The length of the legs 70 is greater between the point at which the upper end of the leg is journaled and the bottom of the side member so that the bottom strand 69 will always be in contact with the surface of the ground whether the apparatus is moving forwardly or in reverse. The suspended strand 69 thus functions as an effective device to dislodge partially depressed or buried golf balls and to enable such dislodged golf balls to be moved up the ramp defined by the strands 68.

To assist the golf balls in moving up the strands 68 and to prevent jamming of the golf balls at the entrance to the lift gate a paddle structure 71 is provided which is fixedly mounted upon an axle 72 at the outer ends of which are attached wheels 73. The wheel and axle structure is loosely positioned with respect to the lift gate 54 by means of axle cradles 74 which are fixed onto extensions 75 at the ends of tow bars 61 as shown, or may be fixed on the ends of the tow bars themselves. These axle cradles provide free vertical movement of axle 72 but limit any movement which might impede paddle operation.

The paddle structure 71 may comprise a solid member having a shape substantially as shown in the drawings and positioned so that the outer edges 76 of the paddle are spaced from the strands 68 about one fourth of an inch as may be seen in FIG. 9. Thus, as the apparatus is dragged forwardly by a tractor or the like, the wheels 73 will rotate upon the ground to cause rotation of the paddle wheel 71 in a counter-clockwise direction as indicated by the arrow 77 and will thus assist in the movement of golf balls upwardly along the strands 68.

Positioned on the inner surface of the side members 67 are stops 79 which are engaged by the legs 70 so as to prevent the leg 70 from moving any higher than a substantially horizontal position. The lowermost strand 68 prevents excessive pivoting movement of the leg 70 in the opposite direction. Thus, the leg 70 and bottom strand 72 are pivotable through an angle of about 200 degrees.

It is preferable that the outer guides 51 and 52 and the inner guides 48 and 49 each have such a length so as to span a distance of about 9 inches measured parallel to the cross bar 26.

When the golf ball retrieving apparatus is in operation and is being pushed or dragged in the forward direction by a tractor or the like, the individual ball containers and guides associated with each container will all closely follow the contour of the ground because of the flexible connections to the cross bar. Further, the wheel and paddle structure associated with the lift gate will also follow the contour of the ground independently of the ball containers because of their independent and flexible connection to the inner guides. As a result, no object as large as a golf ball will be permitted to pass below the guides 48, 49, 51 and 52 or below the catch-all bottom strand of the lift gate. In addition, as the golf balls are pushed up the strands 68 of the lift gate dirt, grass clippings and sediment will be dislodged and the golf balls will be in a reasonably clean condition when they are deposited in the inner tray of the ball container.

Not only does the apparatus according to the present invention have complete terrain flexibility but in practice has shown to have a very high collection efficiency of the golf balls scattered on the normal driving range. Because of this high collection efficiency, the driving range can carry a smaller inventory of golf balls. Further, since the retrieval of the golf balls can be quickly carried out there is also a reduction in ball loss as a result of theft from the field. The apparatus is capable of operation in all weather conditions and requires only minimum maintenance. The pivotable bottom strand on the lift gate or catch-all strand contributes significantly to the effective dislodging of golf balls which may be partially buried and thus significantly increases the collection efficiency of the apparatus.

After a driving range field has been completely traversed by the apparatus, the apparatus is brought back to the teeing point. There, each of the inner trays is lifted from its outer tray and the collected balls may then be poured into the individual buckets which are supplied to the driving range patrons.

It will be understood that this invention is susceptible to modification in order to adapt it to different usages and conditions, and accordingly, it is desired to comprehend such modifications within this invention as may fall within the scope of the appended claims.

What is claimed is:

1. In a ground supported retrieving apparatus for golf balls, means having a flat bottom, upstanding side walls and front and rear walls for defining a golf ball receiving container, there being an opening in said front wall, means for dragging said golf ball container means along and in contact with the ground, guide means supported from said means for dragging and rearwardly converging towards said opening for directing said golf balls towards said opening, means on rearward portions of said guide means and forwardly of said opening for defining an upwardly inclined lift gate to said opening, and means including a horizontal portion having a length substantially equal to a width of said lift gate freely suspended at a forward portion of said lift gate means and having limited pivotable movement so as to remain in contact with the ground for dislodging golf balls which are partially buried in the ground into position in which the golf balls can move upwardly on said inclined lift gate means through said opening into said golf ball receiving container, and rotatable means disposed vertically above said means for dislodging for assisting golf balls to move upwardly along said inclined lift gate into said container.

2. In a retrieving apparatus as claimed in claim 1 wherein said lift gate means comprises a plurality of rigidly supported rods extending transversely to and forwardly of said opening and disposed in stepped relationship.

3. In a retrieving apparatus as claimed in claim 2 wherein said dislodging means comprises a substantially U-shaped rod parallel to and below said rigidly supported rods.

4. In a retrieving apparatus as claimed in claim 3 and further comprising means for stopping pivotal movement of said U-shaped bar at a predetermined point.

5. In a retrieving apparatus as claimed in claim 4 wherein said U-shaped bar has a pair of legs having ends thereof connected by a rod-like base, said legs having other ends pivotally supported, said legs having lengths greater than a distance of support of said U-shaped rod above the ground such that the base bar remains in contact with the ground.

6. In a retrieving apparatus as claimed in claim 4 wherein said means for stopping is engaged by a leg.

7. In a retrieving apparatus as claimed in claim 1 wherein said ball receiving container means comprises an outer tray and an inner tray seated therein.

8. In a retrieving apparatus as claimed in claim 7 wherein said outer tray is supported by ground engaging rollers.

9. In a retrieving apparatus as claimed in claim 7 wherein said outer tray has a pivotable rear wall to facilitate insertion and removal of said inner tray therefrom.

10. In a retrieving apparatus as claimed in claim 1 wherein said means for assisting golf balls upwardly along said lift gate comprises an axle freely mounted on said guide means so as to be capable of vertical movement and ground engaging wheels on the ends of said axle, and a paddle mounted on said axle and disposed at a forward portion of said lift gate and rotated by movement of said wheels on the ground to engage golf balls entering said lift gate.

11. In a retrieving apparatus as claimed in claim 1 wherein said guide means comprises a pair of guide elements disposed in a V having an open apex at said front wall opening, said guide elements each comprising an inner guide adjacent said opening and an outer guide aligned with a said inner guide, said inner and outer guides each having means for attaching independently to said means for dragging and capable of vertical movement to conform to the ground.

12. In an apparatus as claimed in claim 11 wherein said attaching means comprises a tow bar rigidly connected to a said guide and having an end pivotally attached to said means for dragging.

13. In a retrieving apparatus as claimed in claim 1 wherein said means for dragging comprises a plurality of aligned draw bar sections extending transversely to a path of movement of the apparatus when in use, and a plurality of ball receiving container means and a corresponding plurality of guide means connected to each of said draw bar sections.

* * * * *